US008430584B2

(12) United States Patent
Akiyama et al.

(10) Patent No.: US 8,430,584 B2
(45) Date of Patent: Apr. 30, 2013

(54) ELECTRONIC DEVICE

(75) Inventors: Shigeki Akiyama, Ichinomiya (JP); Kenichi Iesaki, Ichinomiya (JP); Kohei Terada, Kiyosu (JP); Mitsuhiro Nozaki, Nagoya (JP); Tomoaki Hazeyama, Yokkaichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 547 days.

(21) Appl. No.: 12/556,279

(22) Filed: Sep. 9, 2009

(65) Prior Publication Data

US 2010/0067926 A1 Mar. 18, 2010

(30) Foreign Application Priority Data

Sep. 12, 2008 (JP) ..... 2008-235114

(51) Int. Cl.
*B41J 2/01* (2006.01)
*B41J 29/42* (2006.01)
*B41J 19/18* (2006.01)

(52) U.S. Cl.
USPC ..... 400/161; 347/19

(58) Field of Classification Search ..... 347/19; 400/161
See application file for complete search history.

(56) References Cited

U.S. PATENT DOCUMENTS 6,722,754 B1 * 4/2004 Delaney et al. ..... 347/19
2007/0096672 A1 5/2007 Endo et al.

FOREIGN PATENT DOCUMENTS

JP 58217383 A * 12/1983
JP 04241975 A * 8/1992
JP 2000-118067 A 4/2000
JP 2003211769 A * 7/2003
JP 2003246111 A * 9/2003
JP 2004142223 A * 5/2004
JP 2005-178334 A 7/2005
JP 2005313331 A * 11/2005
JP 2006021370 A * 1/2006
JP 2006-240026 A 9/2006
JP 2006-247997 A 9/2006
JP 2007-055030 A 3/2007
JP 2007-216698 A 8/2007
JP 2007196556 A * 8/2007
JP 2007-267465 A 10/2007

OTHER PUBLICATIONS

Machine Translation of JP 2005313331 A, JPO, Mar. 1, 2012.*
Machine Translation of JP 2007196556 A, JPO, Mar. 1, 2012.*
Machine Translation of JP 2006021370 A, JPO, Mar. 2, 2012.*
Machine Translation of JP 2003211769 A, JPO, Mar. 2, 2012.*

* cited by examiner

*Primary Examiner* — Matthew G Marini
*Assistant Examiner* — Nguyen Q Ha
(74) *Attorney, Agent, or Firm* — Baker Botts L.L.P.

(57) ABSTRACT

An electronic device includes a carriage conveyance unit, a sheet conveyance unit, a failure detection unit, a position detection unit, and a jam determination unit. The carriage conveyance unit includes a motor and conveys a carriage in a main scanning direction by a driving force of the motor. The sheet conveyance unit conveys a sheet in a sub-scanning direction which crosses the main scanning direction in which the carriage is conveyed. The failure detection unit detects a conveyance failure of the carriage. The position detection unit detects a position of the carriage in the main scanning direction. The jam determination unit determines whether or not the conveyance failure is due to jamming caused by interference between the carriage and the sheet, based on the position of the carriage detected by the position detection unit at a time when the conveyance failure is detected by the failure detection unit.

15 Claims, 11 Drawing Sheets

ELECTRONIC DEVICE

CROSS-REFERENCE TO RELATED APPLICATIONS

This application claims the benefit of Japanese Patent Application No. 2008-235114 filed on Sep. 12, 2008 in the Japanese Patent Office, the disclosure of which is incorporated herein by reference.

BACKGROUND

The present invention relates to an electronic device that conveys a carriage in a main scanning direction and a sheet in a sub-scanning direction, thereby carrying out a predefined process.

In the conventional device, it is unable to correctly determine whether or not the conveyance failure is due to jamming. Therefore, in case that a conveyance failure occurs, it is determined without exception that jamming has occurred. A process appropriate for the conveyance failure due to jamming is carried out after detection of the failure.

Especially, in the case of the conveyance failure due to jamming, different from a conveyance failure due to the other causes than jamming, the nozzle portion of the recording unit may be damaged and the damage may be fatal if conveyance control is forced to continue. Thus, cautious measures have to be taken in case that a conveyance failure is detected. As a result, the conveyance control has to be suspended till apparent operation of error removal is carried out by the user.

Accordingly, in the conventional device, the measures against occurrence of a conveyance failure are likely to be excessive. This may cause dissatisfaction of the user.

SUMMARY

In one aspect of the present invention, it would be desirable that an electronic device (such as an image forming apparatus) is provided which can properly determine whether a conveyance failure is due to jamming.

An electronic device in a first aspect of the present invention may include a carriage conveyance unit, a sheet conveyance unit, a failure detection unit, a position detection unit, and a jam determination unit. The carriage conveyance unit includes a motor and conveys a carriage in a main scanning direction by a driving force of the motor. The sheet conveyance unit conveys a sheet in a sub-scanning direction which crosses the main scanning direction in which the carriage is conveyed. The failure detection unit detects a conveyance failure of the carriage. The position detection unit detects a position of the carriage in the main scanning direction. The jam determination unit determines whether or not the conveyance failure detected by the failure detection unit is due to jamming caused by interference between the carriage and the sheet, based on the position of the carriage detected by the position detection unit at a time when the conveyance failure is detected by the failure detection unit.

BRIEF DESCRIPTION OF THE DRAWINGS

Embodiments of the present invention will now be described below, with reference to the accompanying drawings.

DETAILED DESCRIPTION OF THE PREFERRED EMBODIMENT

Figure 1:
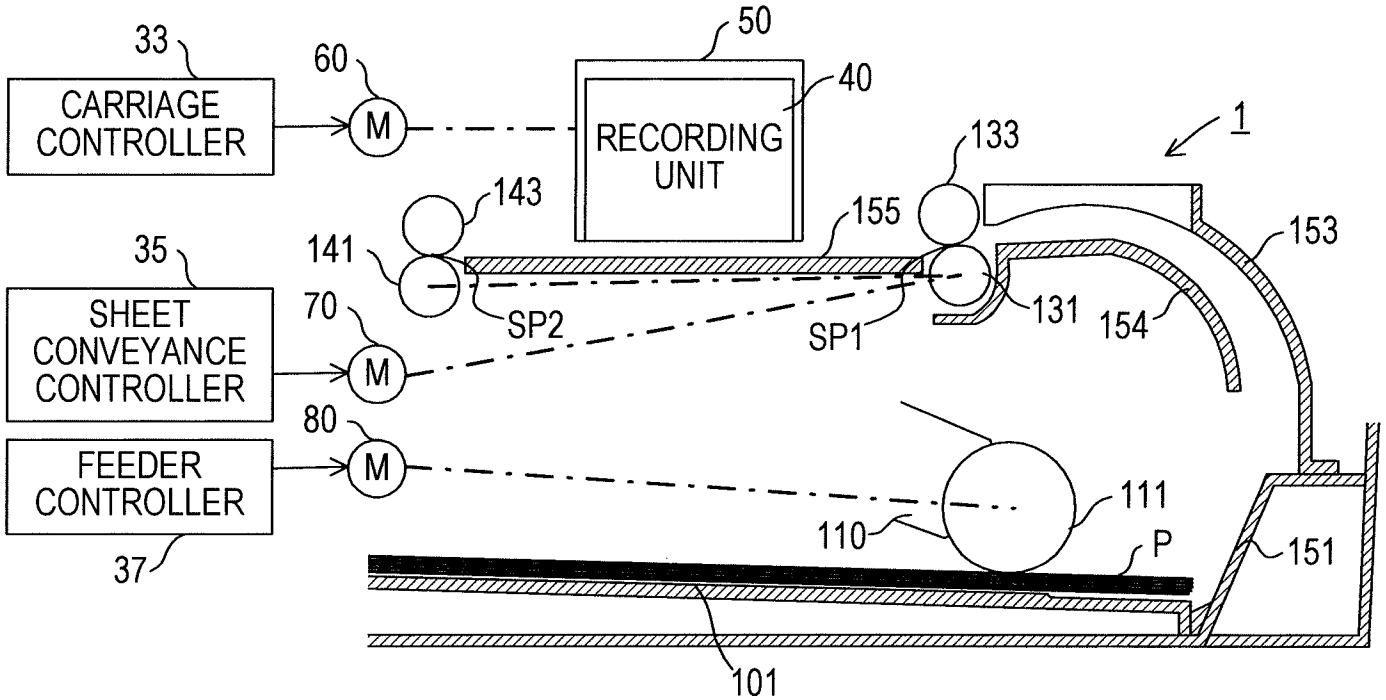
FIG. 1 is a cross sectional view showing a constitution of an image forming apparatus.

Referring to FIG. 1, an image forming apparatus 1 of the present embodiment is configured as an ink-jet printer, including a feeder tray 101, a feeder unit 110, a conveyance roller 131, a discharge roller 141, a bank 151, a U-turn path 153, and a platen 155. In the feeder tray 101, a plurality of sheets P are stacked. The feeder unit 110 delivers the sheets P stored in the feeder tray 101 sheet by sheet onto a conveyance path (hereinafter referred to as a "sheet conveyance path"). The conveyance roller 131 clamps the sheet P, delivered onto the sheet conveyance path by rotation of a feeder roller 111 constituting the feeder unit 110, together with a pinch roller 133 disposed to face the conveyance roller 131. The conveyance roller 131 conveys the sheet P to an ink ejection position below a recording unit 40 by rotating operation. The discharge roller 141 clamps the sheet P delivered from the conveyance roller 131 together with a pinch roller 143 disposed to face the discharge roller 141. The discharge roller 141 discharges the sheet P onto a not shown discharge tray located downstream in the sheet conveyance path by rotating operation. The bank 151, the U-turn path 153 and the platen 155 constitute the sheet conveyance path.

The feeder unit 110 is configured to receive a driving force of a feeder motor 80 constituted from a direct current (DC) motor to rotate the feeder roller 111. The feeder roller 111 is made to abut on top of the sheets P stacked in the feeder tray 101 and separates the uppermost sheet P on the feeder tray 101 to be delivered onto the sheet conveyance path.

An upstream portion of the sheet conveyance path constituted from the bank 151 and the U-turn path 153 is to regulate movement of the sheet P delivered from the feeder roller 111 and guide the sheet P to a contact point SP1 between the conveyance roller 131 and the pinch roller 133 positioned downstream in the sheet conveyance path. On a downstream side below the U-turn path 153, an auxiliary portion 154 is provided to regulate downward movement of the sheet P and guide the sheet P to the contact point SP1 between the conveyance roller 131 and the pinch roller 133.

In the image forming apparatus 1 of the present embodiment, the sheet P delivered from the feeder tray 101 via the feeder roller 111 is guided to the contact point SP1 between the conveyance roller 131 and the pinch roller 133 along the sheet conveyance path constituted as above.

In the image forming apparatus 1, when a front end of the sheet P reaches the contact point SP1, the sheet P is drawn in between the conveyance roller 131 and the pinch roller 133 as the conveyance roller 131 rotates, to be clamped between the conveyance roller 131 and the pinch roller 133. Thereafter, the sheet P is conveyed downstream in the sheet conveyance path (in a sub-scanning direction) by a distance corresponding to an amount of rotation of the conveyance roller 131, as the conveyance roller 131 rotates.

The platen 155 constitutes a downstream portion of the sheet conveyance path connecting the conveyance roller 131 and the discharge roller 141. The platen 155 guides the sheet P delivered from the conveyance roller 131 to the ink ejection position where ink is ejected by the recording unit 40. The platen 155 also guides the sheet P, on which an image is formed by ink ejection operation of the recording unit 40, to a contact point SP2 between the discharge roller 141 and the pinch roller 143.

The sheet P is conveyed to the discharge roller 141 side along the platen 155. When the front end of the sheet P reaches the contact point SP2 between the discharge roller 141 and the pinch roller 143, the sheet P is drawn in between the discharge roller 141 and the pinch roller 143, as the discharge roller 141 rotates, to be clamped by the discharge roller 141 and the pinch roller 143. Thereafter, the sheet P is discharged onto the not shown discharge tray as the discharge roller 141 rotates.

The discharge roller 141 and the conveyance roller 131 are configured to have the same diameter, and driven by the same driving source. The discharge roller 141 and the conveyance roller 131 are connected via a belt and rotate in conjunction with each other. The conveyance roller 131 also rotates by receiving a driving force of an LF motor 70 constituted from a DC motor.

The recording unit 40 includes a plurality of nozzles 40*a* (see FIG. 2) for ejecting ink drops, which are arranged on a bottom surface facing the platen 155. The recording unit 40 is mounted on a carriage 50 which can travel in a main scanning direction (a perpendicular direction toward the sheet surface of FIG. 1). The carriage 50 is driven by a CR motor 60 constituted from a DC motor and travels in the main scanning direction.

Figure 2:
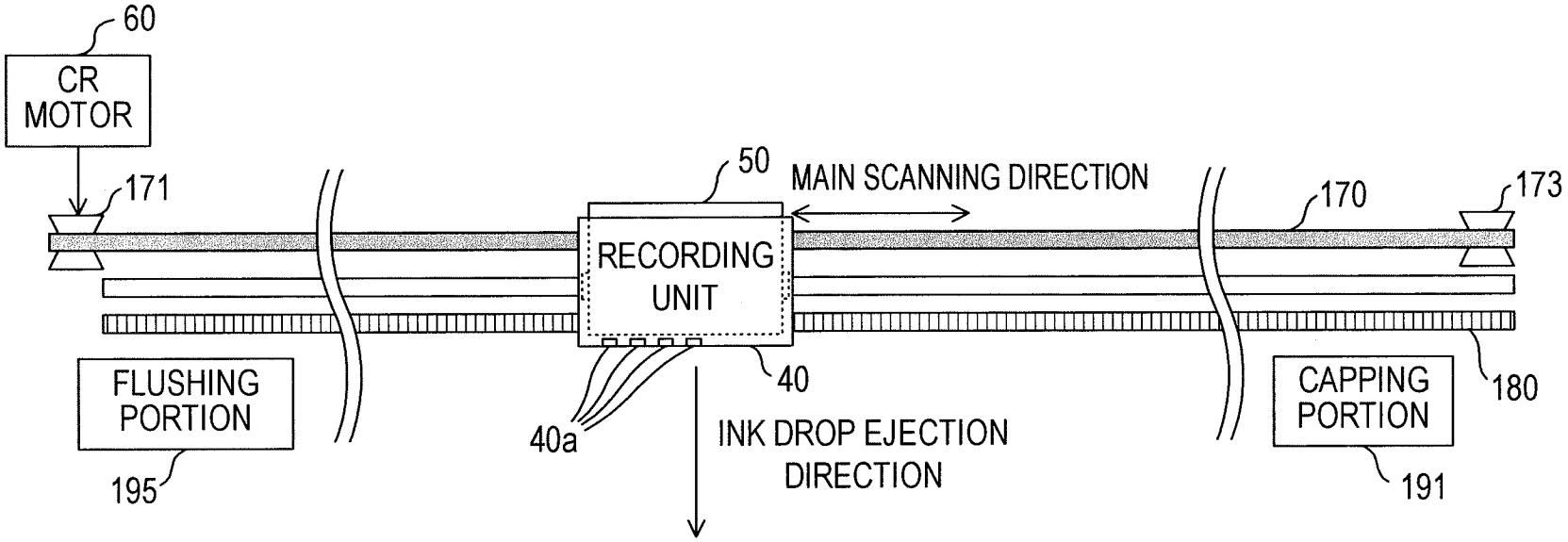
FIG. 2 is a diagram showing a constitution of a carriage conveyance mechanism provided in the image forming apparatus.

FIG. 2 is a diagram showing a constitution of a carriage conveyance mechanism provided in the image forming apparatus 1. The nozzles shown in FIG. 2 are conceptual. The nozzles 40*a* of the recording unit 40 are formed on the bottom surface of the recording unit 40 in the same manner as in a known ink-jet head.

As shown in FIG. 2, in the carriage conveyance mechanism provided in the image forming apparatus 1, the carriage 50 is provided capable of traveling along a guide shaft 160. The carriage 50 is connected to an endless belt 170.

The endless belt 170 is held between a pulley 171 and an idle pulley 173. The pulley 171 rotates by receiving a driving force of the CR motor 60. The endless belt 170 rotates by receiving the driving force of the CR motor 60 via the pulley 171. Specifically, the carriage conveyance mechanism is configured such that the carriage 50 travels in the main scanning direction along the guide shaft 160 as a result of rotation of the endless belt 170 by the driving force of the CR motor 60.

Also in the image forming apparatus 1, a timing slit 180 is provided on which slits are formed at fine intervals along the guide shaft 160, as shown in FIG. 2. A sensor element (not shown) which reads the intervals of the slit formed on the timing slit 180 and outputs pulse signals (encoder signals) corresponding to the position of the carriage 50 is provided in the middle of the main scanning direction of the carriage 50. In the present embodiment, the timing slit 180 and the sensor element constitutes a linear encoder 65.

On an end of a home position (HP) side of a carriage conveyance path along the guide shaft 160, a capping portion 191 is provided. The carriage conveyance path herein indicates an area in the main scanning direction where the carriage 50 can travel along the guide shaft 160.

The capping portion 191 includes a cap and a not shown capping mechanism for capping the cap on the bottom surface of the recording unit 40. The capping portion 191 has the same constitution as that of a known ink-jet printer. Therefore, only a simple description is given here. The capping portion 191 is configured as follows. The capping portion 191 moves the cap downward when the carriage 50 is out of the home position. When the carriage 50 approaches the home position side, the capping portion 191 gradually pushes the cap upward by a pressing force of the carriage 50. When the carriage 50 reaches the home position, the capping portion 191 attaches the cap to the bottom of the recording unit 40 from downward to complete capping.

A flushing portion 195 is provided on an opposite end to the home position on the carriage conveyance path. The flushing portion 195 includes a flushing foam that receives and absorbs ink ejected from the nozzles 40*a* of the recording unit 40. Hereinafter, a point on the carriage conveyance path where the flushing portion 195 is provided is referred to as a "flushing position".

The image forming apparatus 1 of the present embodiment is configured to be fed with sheets in A4 size or smaller. A length in the main scanning direction of the carriage conveyance path is set longer than a length obtained by adding a length in the main scanning direction of an area necessary for capping and an area necessary for flushing to a length (width) in a lateral direction (main scanning direction) of the sheet P in A4 size.

Figure 3:
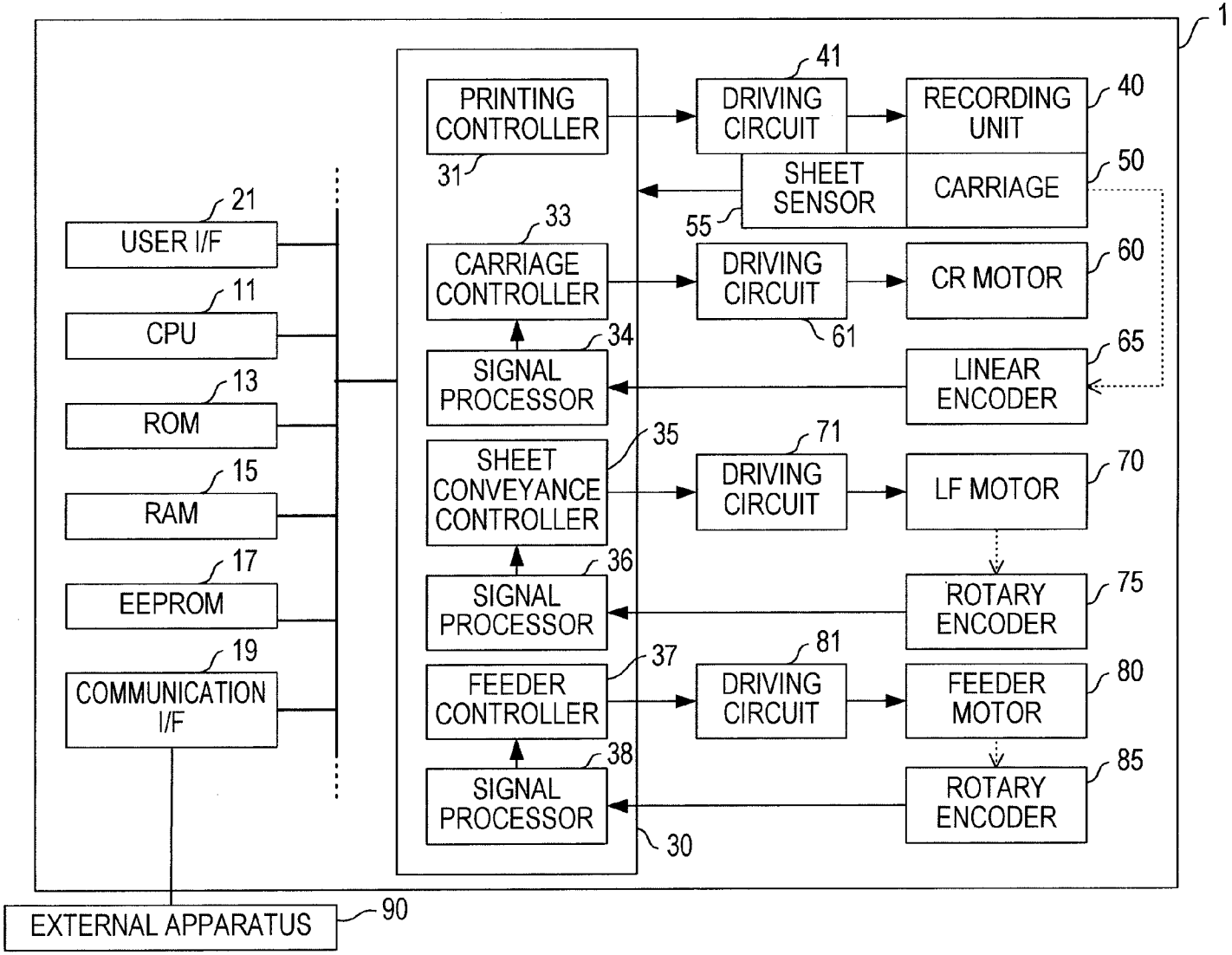
FIG. 3 is a block diagram showing an electric constitution of the image forming apparatus.

Now, description is given on an electric constitution of the image forming apparatus 1. FIG. 3 is a block diagram showing an electric constitution of the image forming apparatus 1. The image forming apparatus 1 of the present embodiment includes, other than the above-described components, a CPU 11, a ROM 13, a RAM 15, an EEPROM 17, a communication interface 19, a user interface 21, a printing/motor controller 30, driving circuits 41, 61, 71, 81, rotary encoders 75, 85, and a sheet sensor 55. The ROM 13 stores programs and the like executed by the CPU 11. The RAM 15 is used as a work area when the CPU 11 executes the programs. The EEPROM 17 stores various setting information. The communication interface 19 receives print image data transmitted from an external apparatus 90. The user interface 21 includes various operation keys, a liquid crystal display for displaying messages, and a speaker. The driving circuits 41, 61, 71, 81 respectively drives the recording unit 40, the CR motor 60, the LF motor 70, and the feeder motor 80.

The printing/motor controller 30 includes a printing controller 31, a carriage controller 33, a sheet conveyance controller 35, a feeder controller 37, and signal processors 34, 36, 38. The printing controller 31 controls ejection operation of ink drops by the recording unit 40. The printing controller 31 drives the recording unit 40 through the driving circuit 41 in accordance with a command inputted from the CPU 11 to control the ejection operation of ink drops by the recording unit 40. Particularly, the printing controller 31 directs the recording unit 40 to form an image based on the print image data inputted from the CPU 11 onto the facing sheet P by controlling the ejection operation of ink drops.

The carriage controller 33 conducts conveyance control of the carriage 50. In order to position ink drops on a targeted spot, it is necessary to control the carriage 50 to travel at a constant speed during image formation. The carriage controller 33 performs such conveyance control of the carriage 50 in accordance with a command from the CPU 11. Particularly, the carriage controller 33 drives the CR motor 60 (via the driving circuit 61) to control a driving voltage or current of the CR motor 60, thereby achieving the conveyance control of the carriage 50 (details are explained later). Also, information of a position X and a speed V of the carriage 50 is inputted to the carriage controller 33 from the signal processor 34 for the above conveyance control.

The signal processor 34 processes encoder signals (A-phase signals and B-phase signals) inputted from the linear encoder 65 to derive the position X and the speed V of the carriage 50. A derivation method of the position X and the speed V using the encoder signals are known. Therefore, only a simple description is given here. For example, the signal processor 34 detects edges of the encoder signals inputted from the linear encoder 65, measures edge detection intervals with respect to the A-phase signals (time intervals between the adjacent edges), and inputs to the carriage controller 33 a reciprocal of the measured time intervals (edge detection intervals) as the speed V of the carriage 50. Moreover, a travel direction of the carriage 50 is specified from a phase difference between the A-phase signal and the B-phase signal. When the carriage 50 travels "forward", a variable X representing the position of the carriage 50 is incremented by one per edge detection of the A-phase signal. When the carriage 50 travels "backward", the variable X representing the position of the carriage 50 is decremented by one per the edge detection. Thereby, the position X of the carriage 50 is obtained. Information on the position X of the carriage 50 is necessary for ejection control of ink drops. Thus, the information is also inputted to the printing controller 31.

The sheet conveyance controller 35 controls the LF motor 70 through the driving circuit 71 in accordance with a command from the CPU 11, thereby to control conveyance of the sheet P. Information on an amount and a speed of the conveyance of the sheet P is inputted to the sheet conveyance controller 35 from the signal processor 36. Particularly, the rotary encoder 75 is provided on a rotation shaft of the LF motor 70. The signal processor 36 derives the amount and the speed of the conveyance of the sheet P based on the encoder signals inputted from the rotary encoder 75 and inputs the information to the sheet conveyance controller 35.

The feeder controller 37 controls the feeder motor 80 through the driving circuit 81 in accordance with a command from the CPU 11, thereby feeding the sheet P from the feeder tray 101 to the conveyance roller 131 side. To the feeder controller 37, the information on the amount and the speed of the conveyance of the sheet P is inputted from the signal processor 38. Particularly, the rotary encoder 85 is provided on a rotation shaft of the feeder motor 80. The signal processor 38 derives the amount and the speed of the conveyance of the sheet P based on the encoder signals inputted from the rotary encoder 85 and inputs the information to the feeder controller 37.

The CPU 11 inputs commands to each portion of the printing/motor controller 30 constituted as such, thereby integrally controlling image forming operation in the main scanning direction and conveyance operation of the sheet P in a sub-scanning direction orthogonal to the main scanning direction, and forming an image based on the print image data inputted from the external apparatus 90 onto the sheet P.

Also, when a conveyance failure is detected by the carriage controller 33 during conveyance of the carriage 50 accompanying the image forming operation, the CPU 11 determines whether or not the conveyance failure is due to jamming based on the information on the position X of the carriage 50 upon occurrence of the conveyance failure. In accordance with a result of the determination, a process corresponding to the conveyance failure that has occurred is carried out (print control process).

Figure 4:
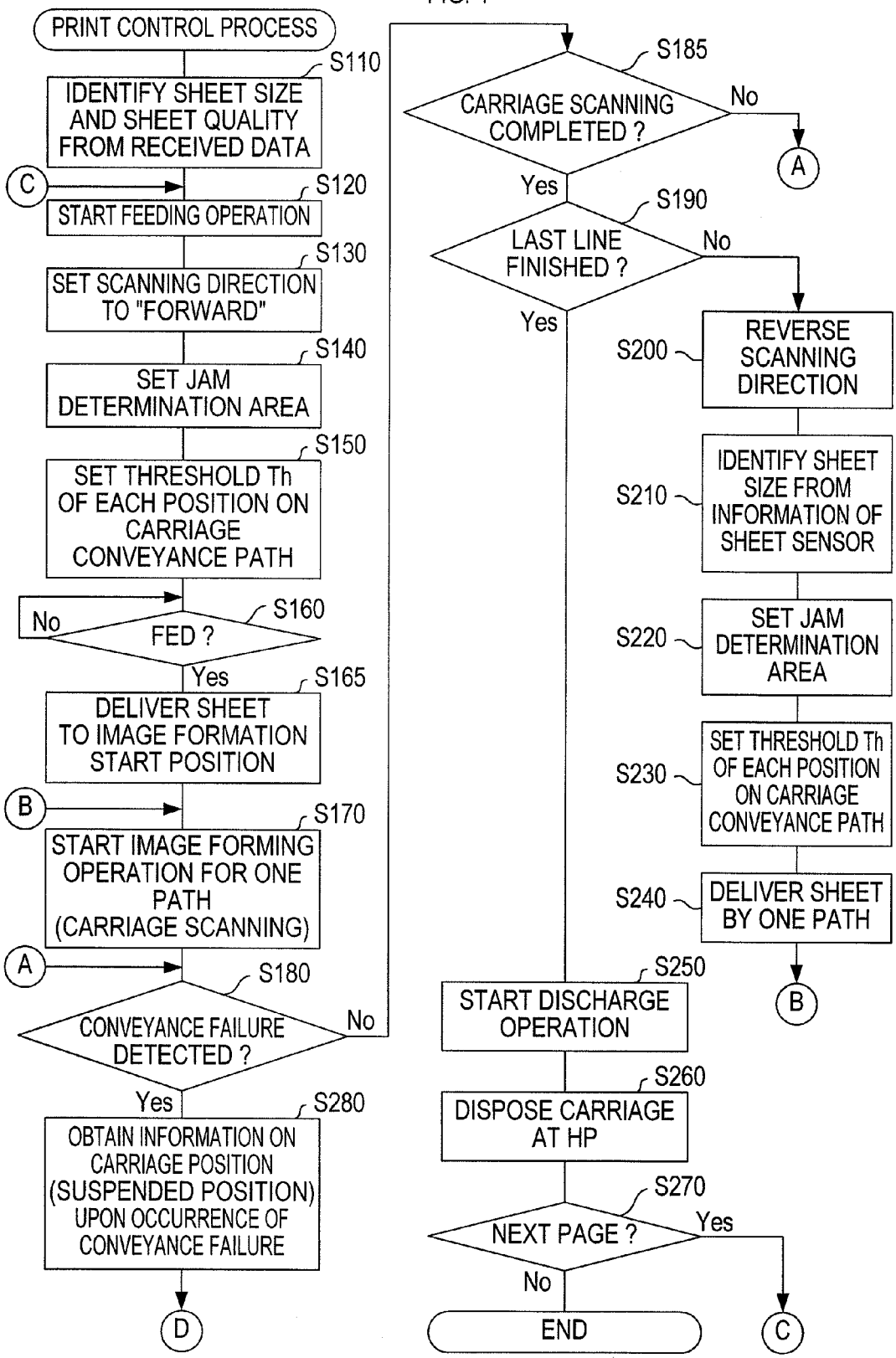
FIG. 4 is a flowchart illustrating a print control process executed by a CPU.
Figure 5:
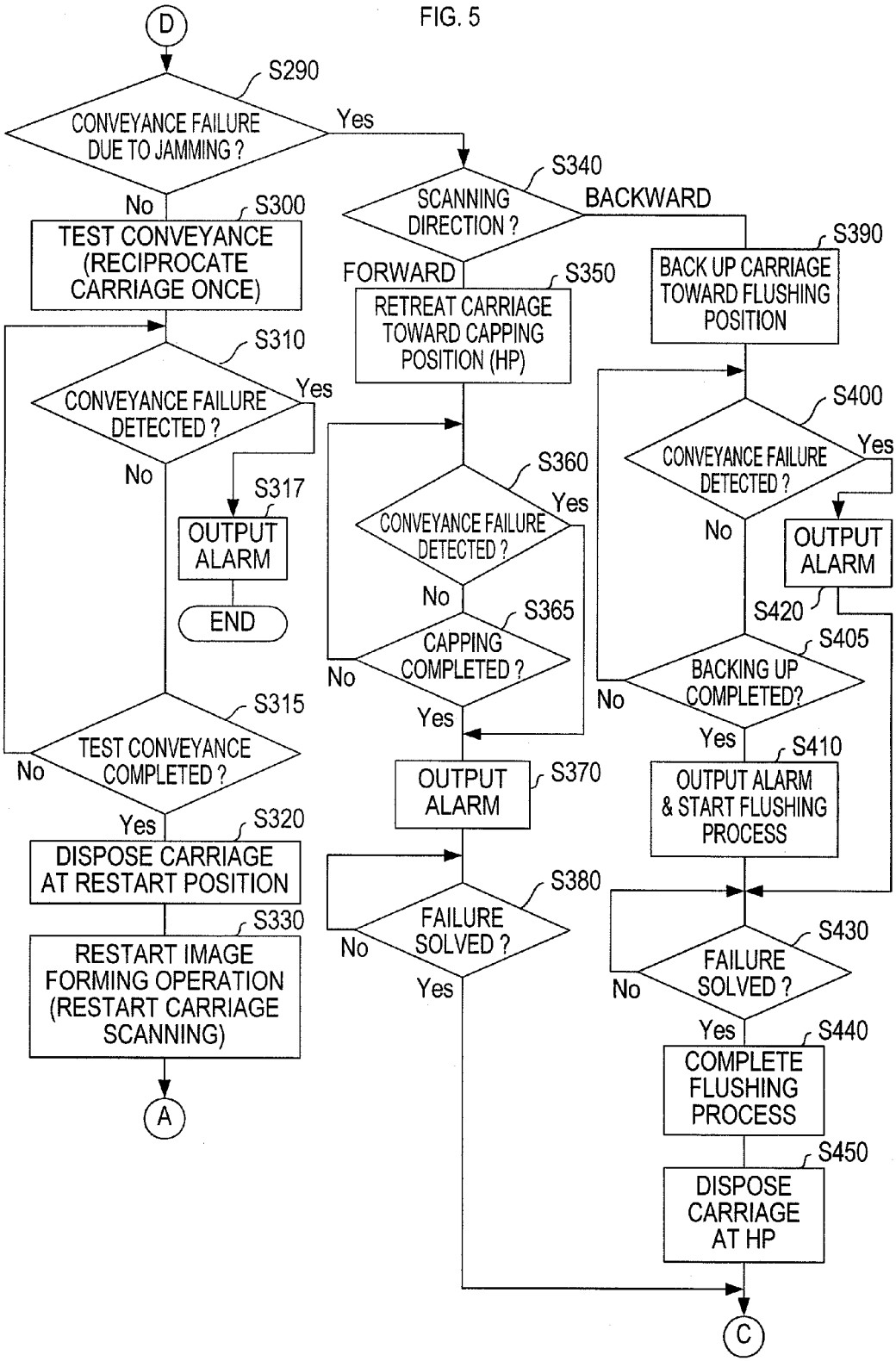
FIG. 5 is a flowchart illustrating the print control process executed by the CPU.

Now, description is given on the print control process executed by the CPU 11. FIGS. 4 and 5 are flowcharts illustrating the print control process executed by the CPU 11. The CPU 11, when receiving a print command and the print image data from the external apparatus 90 through the communication interface 19, starts the print control process shown in FIGS. 4 and 5.

When the print control process is started, the CPU 11 identifies the sheet size and sheet quality of the sheet P fed from the feeder tray 101 based on data received from the external apparatus 90 (S110). The reason for identifying the sheet size and sheet quality is to specify an area where jamming may occur and an area where jamming never occurs on the carriage conveyance path.

Specifically, the external apparatus 90 of the present embodiment is configured to transmit information on the sheet quality (such as plain, glossy, postcard, etc.) and the sheet size (such as A4, B5, A5, etc.) as the print setting data, together with the print command and the print image data. The CPU 11 identifies in S110 the sheet size and sheet quality of the sheet P fed from the feeder tray 101 based on the information indicated by the print setting data received together with the print image data.

The reason why the sheet quality is identified is because the manner of occurrence of jamming is varied depending on "deformability" of the sheet. The "deformability" is changed under the influence of the material, finishing, sheet thickness, and so on. It is difficult to obtain information on the "deformability" from the user. Also, it is difficult to measure on the sheet conveyance path the "deformability" of the sheet P placed on the feeder tray 101.

It is possible to obtain information on sheet thickness, by making the user input a particular value of sheet thickness. However, such input operation may demand excessive setting operation of the user. User-friendliness of the image forming apparatus 1 may be impaired.

Accordingly, in the present embodiment, the information on the sheet quality (such as plain, glossy, postcard, etc.) is used as an index indicating the "deformability". In the present embodiment, a later-described process will be carried out based on the information on the identified sheet quality, assuming that the glossy paper is thicker than the plain paper and the postcard is thicker than the glossy paper.

When the sheet size and the sheet quality are identified in S110, the CPU 11 inputs a command to the feeder controller 37 to start feeding operation by the feeder unit 110 (S120). In other words, in S120, the CPU 11 makes the feeder controller 37 control the feeder motor 80 so that the feeding operation is started by the feeder unit 110.

When the feeding operation is started, the CPU 11 sets a scanning direction of the carriage 50 to "forward" (S130). In the present embodiment, the main scanning direction which heads from the home position toward the flushing position is called "forward". The main scanning direction which heads from the flushing position toward the home position is called "backward".

After S130, the process moves to S140 and the CPU 11 sets a jam determination area based on the currently set scanning direction and the information on the identified sheet size and sheet quality. The jam determination area is an area on the carriage conveyance path, where a conveyance failure which occurs should be determined as jamming.

Figure 6:
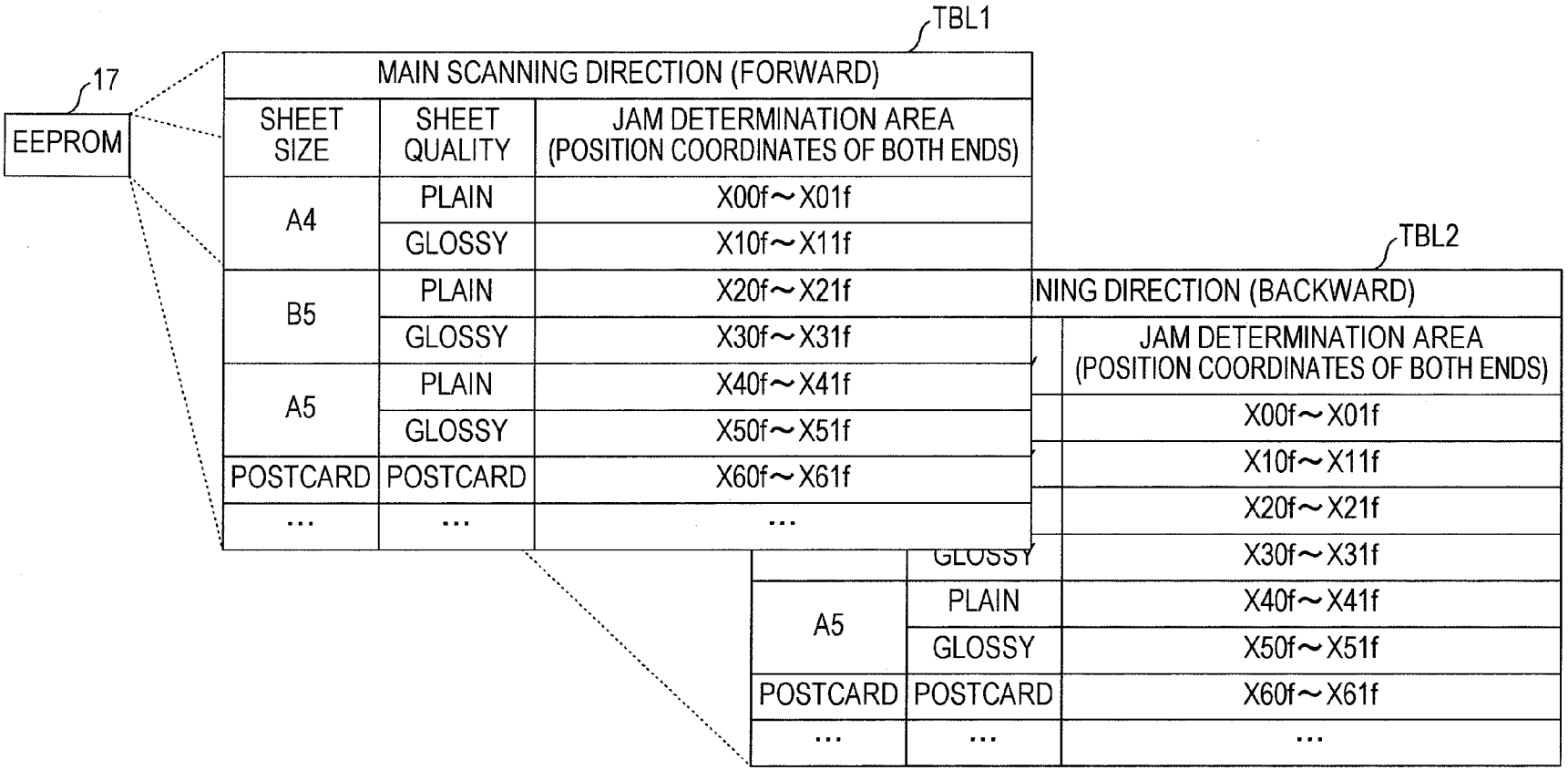
FIG. 6 is a diagram showing a constitution of area definition tables.

In detail, the EEPROM 17 stores area definition tables indicating areas in the main scanning direction which should be set as the jam determination area. The CPU 11 sets the jam determination area in the main scanning direction in accordance with the area definition tables. FIG. 6 is a table showing a constitution of the area definition tables.

In the EEPROM 17, a forward area definition table TBL1 to be referred to when the scanning direction is set to "forward", and a backward area definition table TBL2 to be referred to when the scanning direction is set to "backward", are stored as the area definition tables. In each of the area definition tables, an area to be set as the jam determination area is defined and written by position coordinates of both ends of the area per sheet size and sheet quality. The position coordinates of both ends of the area are expressed by a coordinate system of the carriage 50 obtained from the signal processor 34.

Figure 7:
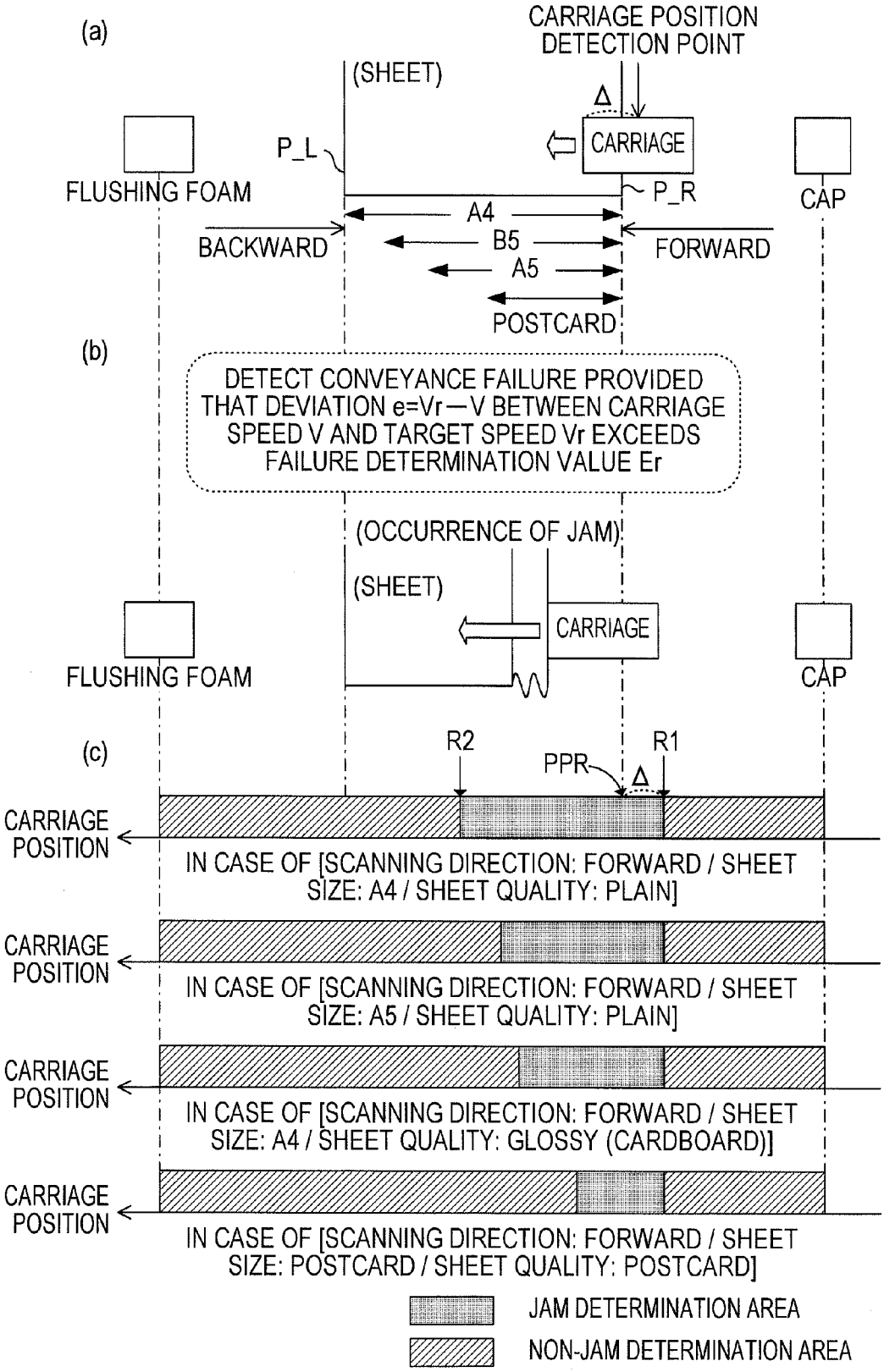
FIG. 7 is an explanatory view showing a jam determination area in case that a scanning direction is "forward"
Figure 8:
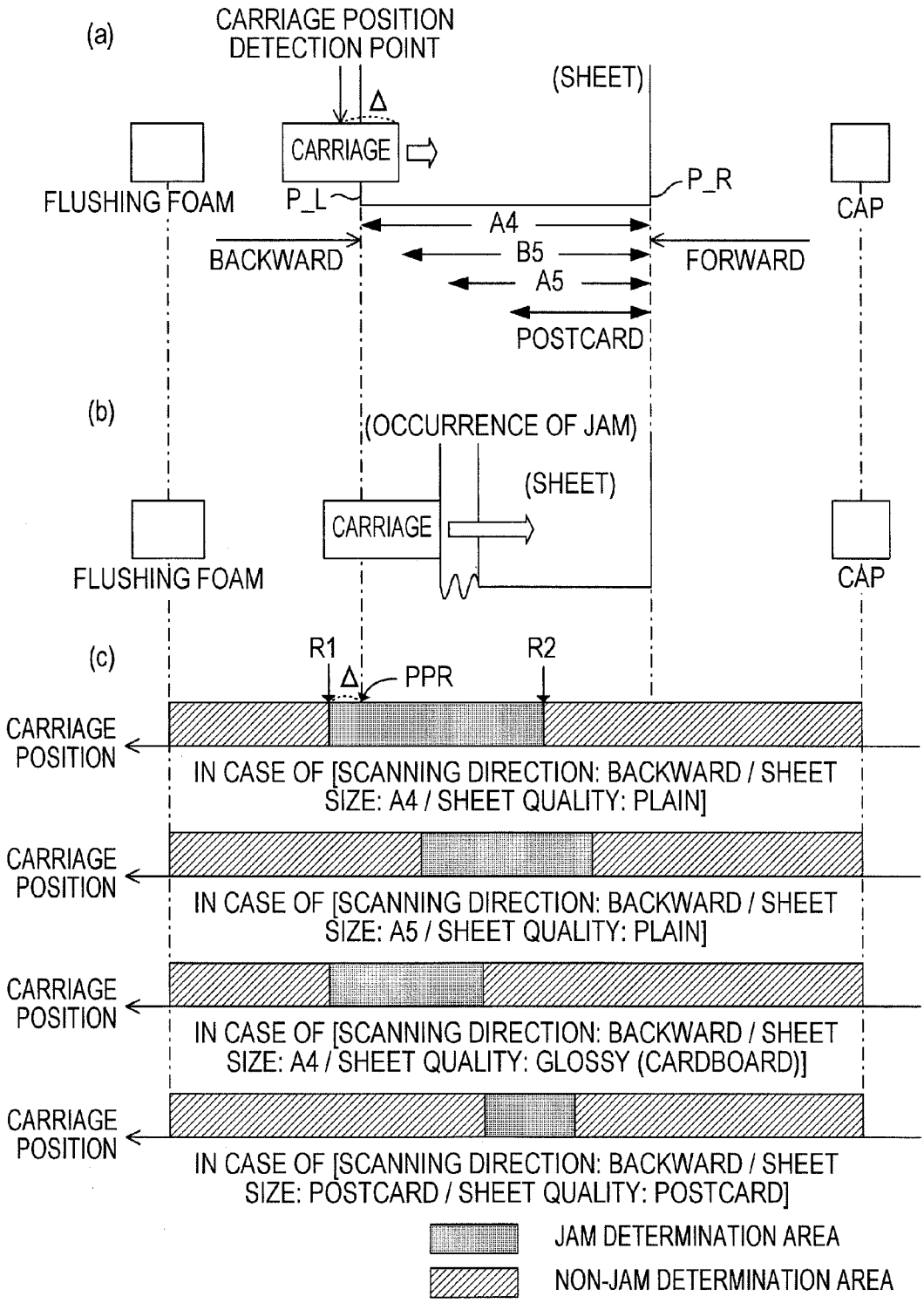
FIG. 8 is an explanatory view showing the jam determination area in case that the scanning direction is "backward"

The jam determination area is predefined at a design stage. Specifically, the passing area of the sheet P which crosses the carriage conveyance path can be uniquely determined from the constitution of the image forming apparatus 1. As shown in FIGS. 7 and 8, an origin R1, located upstream in the scanning direction of the area to be set as the jam determination area, is defined to a position where a front end located downstream in the scanning direction of the carriage 50 is brought into contact with one of right and left side edges of the sheet P positioned upstream in the scanning direction. FIG. 7 is an explanatory view showing the jam determination area with respect to the "forward" direction. FIG. 8 is an explanatory view showing a jam determination area with respect to the "backward" direction.

Firstly, detailed description will be given on how to define the jam determination area for the "forward" direction, referring to FIG. 7. When the scanning direction is set to "forward", the carriage 50 is conveyed "forward", that is, from the home position toward the flushing position, by a later-explained step of S170.

Accordingly, assuming that the home position side in the carriage conveyance path is defined as "right" and the flushing position side is defined as "left", the carriage 50, as shown in a section (a) of FIG. 7, travels from a position facing a right side edge P_R of the sheet P (a right end of the sheet passing area) to an inner side area of the sheet P (an inner side of the sheet passing area), and thereafter, goes out of the sheet passing area from a position facing a left side edge P_L of the sheet P (a left side of the sheet passing area). As shown in a section (b) of FIG. 7, jamming may occur due to the carriage 50 being caught by the right side edge P_R of the sheet P.

In the image forming apparatus 1 of the present embodiment, as shown in the section (b) of FIG. 7, the conveyance failure is detected under a condition that the deviation $e=Vr-V$ between the actual speed V and the target speed Vr of the carriage 50 exceeds a failure determination value Er. Depending on whether the position X of the carriage 50 obtained from the signal processor 34 upon detection of the conveyance failure is within the jam determination area, whether or not the conveyance failure is due to jamming is determined.

Accordingly, the conveyance failure is detected later than a time when the carriage 50 has brought into contact with the sheet P and the jamming has started to occur. Thus, the "position X of the carriage 50 upon detection of the conveyance failure", which becomes an index to determine whether or not the conveyance failure is due to jamming, is a position approximately inside of the sheet passing area from the right side edge P_R of the sheet P.

Therefore, the jam determination area for the "forward" direction is set downstream in the scanning direction of the origin R1, by setting as the origin R1 the position on the carriage conveyance path where the front end in the scanning direction of the carriage 50 is bought into contact with the right side edge P_R of the sheet P.

A sensor element constituting the linear encoder 65 is provided in the middle of the main scanning direction of the carriage 50. A carriage position detection point is located in the middle of the main scanning direction of the carriage 50. Specifically, since the position X of the carriage 50 obtained from the signal processor 34, as shown in the section (a) of FIG. 7, is shifted by Δ from the front end position in the main scanning direction of the carriage 50, the origin R1 of the jam determination area is correspondingly defined to a position shifted upstream in the scanning direction by Δ from a position PPR where the right side edge P_R of the sheet P passes.

An end point R2 of the jam determination area is defined in consideration of "deformability" of the sheet P. Particularly, jamming is purposely generated as a test at a design stage. When jamming occurs, statistic data concerning which position in the carriage conveyance path the conveyance failure is detected is obtained per sheet quality.

Then, a position that satisfies the below conditions is defined to the end point R2 of the jam determination area, that is, a position where a "probability to be determined that the conveyance failure is not due to jamming, although jamming has occurred, because the position X of the carriage 50 is not within the jam determination area" (jam erroneous determination rate) is within an acceptable range (e.g., zero), and a position where the length in the main scanning direction of the jam determination area is the shortest.

In the present embodiment, the area appropriate for the jam determination area is defined by testing at a design stage as such. The information on the area is reflected on the area definition tables so as to create the forward area definition table TBL1.

When the forward area definition table TBL1 is created as in the above-described manner, the area to be set as the jam determination area is defined, for example, as shown in a section (c) of FIG. 7. In case that the sheet size is the same, the "glossy" sheet is thicker than the "plain" sheet. Thus, the length in the main scanning direction of the above area is defined shorter in the case of the "glossy" sheet than the case of the "plain" sheet. In case that the sheet quality is the same, the length in the main scanning direction of the above area is defined shorter as the sheet size becomes smaller.

A boundary of the end point R2 of the jam determination area, in the case of the "forward" direction, is the "position where the front end in the scanning direction of the carriage 50 reaches the left side edge P_L of the sheet P". The conveyance failure due to jamming is not basically detected at a time when the carriage 50 travels downstream in the scanning direction of the left side edge P_L of the sheet P, as long as the left side edge P_L of the sheet P is regulated not to move by the conveyance roller 131 and others.

The backward area definition table TBL2 is created according to the same concept as that of the forward area definition table TBL1. Points to consider upon defining the jam determination area for the "backward" direction is that, since the scanning direction of the carriage 50 is different, jamming occurs due to a contact between the left side edge P_L of the sheet P and the carriage 50 (see a section (b) of FIG. 8), and that, since the image forming apparatus 1 is configured such that the right side edge P_R of the sheet P passes the same position of the sheet conveyance path regardless of the sheet size, the position of the left side edge P_L of the sheet P which is a reference to determine the origin R1 of the jam determination area is changed depending on the sheet size (see a section (a) of FIG. 8).

Specifically, when the scanning direction is set "backward", the carriage 50 is conveyed from the flushing position toward the home position by the later-explained step of S170. Thus, the carriage 50, as shown in the section (a) of FIG. 8, travels from the position facing the left side edge P_L of the sheet P (a left end of the sheet passing area) to the inner side area of the sheet P (the inner side of the sheet passing area), and thereafter, goes out of the sheet passing area from a position facing the right side edge P_R of the sheet P (the right end of the sheet passing area). Jamming may occur due to the carriage 50 being caught by the left side edge P_L of the sheet P.

Therefore, the jam determination area for the "backward" direction is set downstream of the origin R1 in the scanning direction of the origin R1, by setting as the origin R1 a position on the carriage conveyance path where the front end in the scanning direction of the carriage 50 is bought into contact with the left side edge P_L of the sheet P.

Similar to the case in the "forward" direction, a sensor element constituting the linear encoder 65 is provided in the middle in the main scanning direction of the carriage 50. The carriage position detection point is in the middle of the main scanning direction of the carriage 50. The position X of the carriage 50 obtained from the signal processor 34, as shown in the section (a) of FIG. 8, is shifted by Δ from the front end position in the scanning direction of the carriage 50. Moreover, since the position where the left side edge P_L of the sheet P passes is different per the sheet size, the origin R1 of the jam determination area corresponding to each sheet size is set to a respective position shifted upstream in the scanning direction by Δ from a position PPL where the left side edge P_L of the sheet P passes. Also, the end point R2 of the jam determination area with respect to each sheet size and sheet quality is set to a position located downstream in the scanning direction away from the origin R1 of the jam determination area by the same distance as the length in the main scanning direction of the jam determination area for the "forward" direction with respect to the same sheet size and sheet quality.

In the present embodiment, an appropriate area is determined as the jam determination area as noted above, and the backward area definition table TBL2 is created which indicates that area. In the present embodiment, since the carriage position detection point is set in the middle in the main scanning direction of the carriage 50, the value Δ coincides in both the forward and backward directions. The value Δ may be different in the forward and backward directions.

In S140, based on one of the area definition tables of the forward area definition table TBL1 and the backward area definition table TBL2 stored in the EEPROM 17 which corresponds to the currently set scanning direction, the jam determination area is set which corresponds to the currently identified sheet size and sheet quality. Thereafter, the process moves to S150.

In S140, since the scanning direction is set to "forward", the jam determination area is set based on the forward area definition table TBL1. The backward area definition table TBL2 is referred to in the step S220 when the scanning direction is reversed and set to "backward" (details will be later explained).

In S150, the CPU 11 assumes the area other than the jam determination area set in S140 on the carriage conveyance path as a non-jam determination area. The threshold Th of each position on the carriage conveyance path is set. The threshold Th is set for the carriage controller 33. The threshold Th is used as the above-described failure determination value Er in the carriage controller 33 (see FIGS. 7 and 10).

Figure 9A:
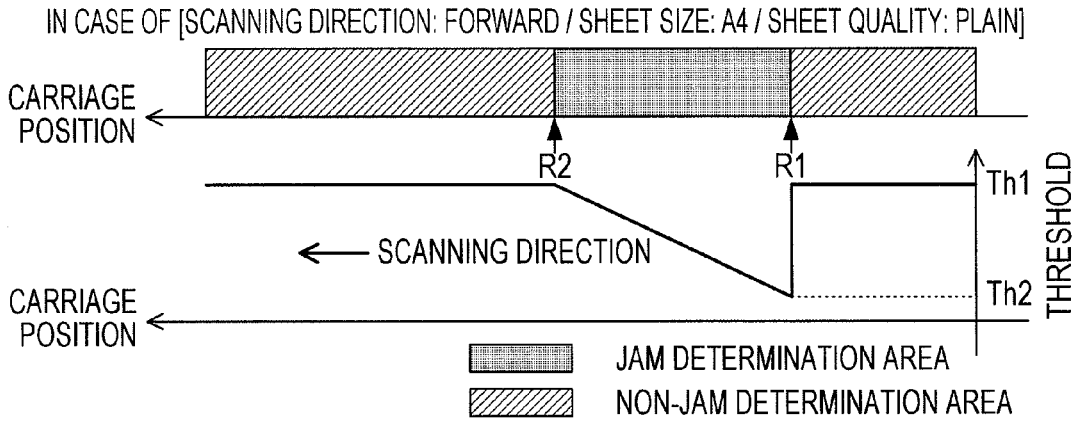
FIGS. 9A-9C are explanatory views respectively showing an example of configuration of a threshold Th.
Figure 9B:
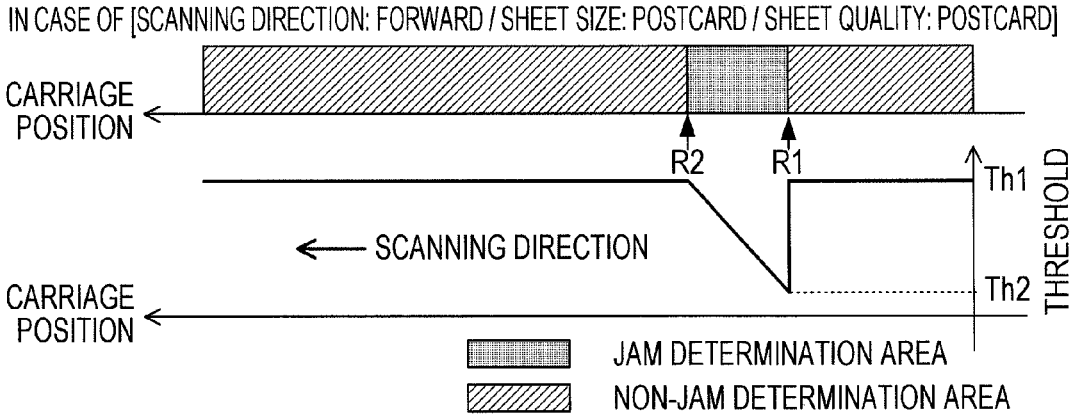
Figure 9C:
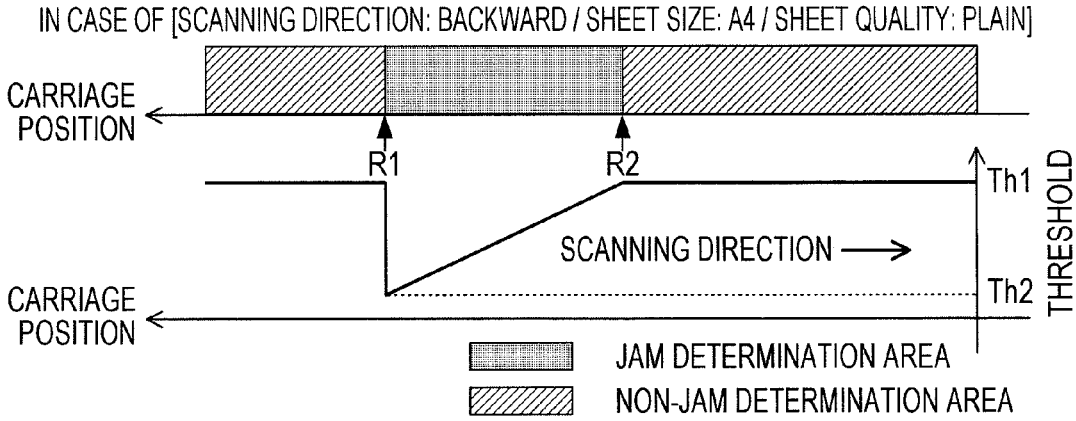

Particularly, in S150, the threshold Th of each position in the non-jam determination area is set to a first threshold Th1 defined at a design stage as an optimum value to detect the conveyance failure other than jamming (see FIGS. 9A-9C). The threshold Th of the position R1 located most upstream in the main scanning direction in the jam determination area is set to a second threshold Th2 defined as an optimum value for detecting the conveyance failure due to jamming.

The second threshold Th2 should be a value smaller than the first threshold Th1. Regarding the conveyance failure due to jamming, the nozzle portion of the recording unit 40 will be damaged if detection of the conveyance failure is delayed. Therefore, it is preferable that the conveyance failure is detected with high sensitivity.

Thereby, in the present embodiment, a value sufficiently smaller than the first threshold Th1 is adopted as the second threshold Th2. By setting the thresholds as such, the conveyance failure can be detected with the small deviation e around the side edges (the outer edge) of the sheet P located on the upstream side in the scanning direction.

The threshold Th of each of the other positions in the jam determination area is set in such a manner as to smoothly change (increase) from the threshold Th2 to the threshold Th1, over a distance from the origin R1 located upstream in the scanning direction of the jam determination area to the end point R2 located downstream in the scanning direction.

FIGS. 9A-9C are explanatory views respectively showing an example of configuration of the threshold Th. In the example shown in FIGS. 9A-9C, the threshold Th of each position from the origin R1 located upstream in the scanning direction of the jam determination area to the end point R2 located downstream in the scanning direction is linearly defined.

Particularly, FIG. 9A shows the threshold Th when the scanning direction is "forward", the sheet size is "A4", and the sheet quality is "plain". FIG. 9B shows the threshold Th when the scanning direction is "forward", the sheet size is "postcard", and the sheet quality is "postcard". FIG. 9C shows the threshold Th when the scanning direction is "backward", the sheet size is "A4", and the sheet quality is "plain".

In the present embodiment, it is not possible to obtain position information with higher-precision than the position X obtained from the signal processor 34. Therefore, the threshold Th of each position on the carriage conveyance path is set per smallest unit of the position X obtained from the signal processor 34. The threshold Th may not be set as a discrete value but set as a function (e.g., a primary function) having the thresholds Th1 and Th2 and the positions X of the right and left ends of the jam determination area as parameters.

After S150, the CPU 11 stands by until the feeding operation started in S120 is completed (S160). When the feeding operation is completed (S160: Yes), the CPU 11 inputs a command to the sheet conveyance controller 35 to make the sheet conveyance controller 35 convey the fed sheet until an image forming start position (a leading line) reaches the ink ejection position by the recording unit 40 (S165).

Thereafter the CPU 11 inputs a command to the printing/motor controller 30 to make the printing/motor controller 30 start the image forming operation for one path (S170). The "image forming operation for one path" indicates operation of forming an image for a predetermined number of lines (e.g., for one line, which depends on capacity of the recording unit 40) onto the sheet P by moving the carriage 50 in the scanning direction at a constant speed for one way for carriage scanning while ejecting ink drops from the recording unit 40.

For example, in S170, the received print image data of the line for which the printing controller 31 is urged to form an image is inputted to the printing controller 31. Also, a target speed trajectory (the target speed Vr at each time), a deceleration start position, the scanning direction and others are designated and the carriage controller 33 is made to convey the carriage 50 in the scanning direction set in the previous step (S130 or S200). In this manner, the image forming operation for one path is started by the printing/motor controller 30.

Figure 10:
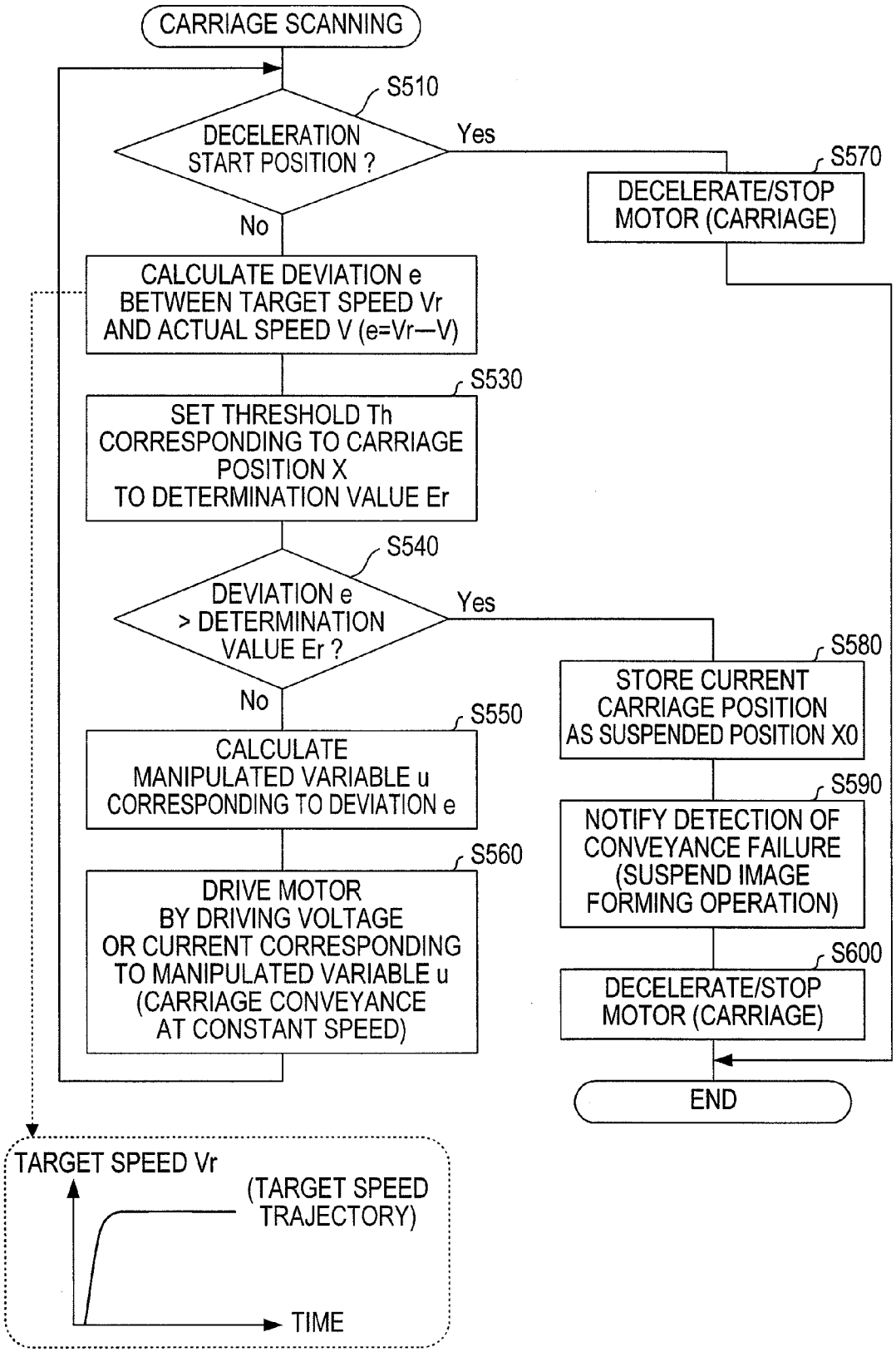
FIG. 10 is a flowchart illustrating a process executed by a carriage controller.

Here, the description on the print control process executed by the CPU 11 is temporarily suspended. A description is given on a process executed by the carriage controller 33 by a command inputted from the CPU 11 in S170 by way of FIG. 10. FIG. 10 is a flowchart illustrating the process executed by the carriage controller 33 in receipt of the command from the CPU 11 in S170.

The carriage controller 33, in receipt of the command from the CPU 11, executes the steps from S520-S560 until the position X of the carriage 50 obtained from the signal processor 34 reaches a deceleration start point (S510: No). Particularly, the deviation e=Vr−V between the target speed Vr and the actual speed V obtained from the signal processor 34 is calculated (S520).

The CPU 11 designates the target speed trajectory shown in a lower section of FIG. 10, thereby making the carriage 50 smoothly shift from an acceleration state to a constant speed state. After the calculation of the deviation e, the threshold Th set in the previous step by the CPU 11 (S150 or S230) and of the position corresponding to the current position of the carriage 50 obtained from the signal processor 34 is set to the failure determination value Er (S530). It is then determined whether or not the deviation e exceeds the failure determination value Er (S540).

When it is determined that the deviation e is not more than the failure determination value Er (S540: No), a manipulated variable u corresponding to the deviation e is calculated from a prescribed transfer function (S550). By setting the calculated manipulated variable u to the driving circuit 61, the CR motor 60 is driven by the driving circuit 61 with a driving voltage or driving current corresponding to the manipulated variable u (S560).

As noted above, the carriage controller 33 determines the driving voltage or the driving current to be inputted to the CR motor 60 from the deviation e. Thereby, the speed in the main scanning direction of the carriage 50 is feedback controlled to be consistent with the target speed Vr. The carriage 50 is controlled at a constant speed (S560).

After S560, the process moves to S510. When the carriage 50 reaches the deceleration start position, the process moves to S570. The CR motor 60 (and indirectly the carriage 50) is decelerated/stopped. Thereby carriage scanning for one path is completed.

When it is determined that the deviation e exceeds the failure determination value Er (S540: Yes), the carriage controller 33 stores the current position X of the carriage obtained from the signal processor 34 as a suspended position X0 (S580), and notifies the CPU 11 of detection of a conveyance failure (S590). Also, by notifying the printing controller 31 of detection of the conveyance failure, the carriage controller 33 makes the printing controller 31 suspend ink ejection operation.

After S590, the process moves to S600. The CR motor 60 (carriage 50) is decelerated/stopped. In this manner, in the case of detection of the conveyance failure, carriage scanning is temporarily suspended. The "image forming operation for one path" is temporarily suspended.

Now, the description is returned to the print control process executed by the CPU 11. The CPU 11, after the "image forming operation for one path" is started, stands by until a conveyance failure is detected by the carriage controller 33 or carriage scanning is completed (S180, S185).

When carriage scanning is completed without detection of a conveyance failure (without receiving notification of conveyance failure detection) (S185: Yes), the process moves to S190 and it is determined whether the "image forming operation for one path" is executed till the last line on one page. If it is determined that the "image forming operation for one path" is not executed till the last line (S190: No), the scanning direction is reset to an opposite direction to the currently set direction (S200).

Specifically, when the scanning direction is set to "forward", the scanning direction is reset to "backward". When the scanning direction is set to "backward", the scanning direction is reset to "forward". By reversing the scanning direction as above, the image forming apparatus 1 of the present embodiment makes the carriage 50 reciprocate.

When the scanning direction is reset (S200), the sheet size fed from the feeder tray 101 is reidentified based on the detection result of the sheet ends obtained from the sheet sensor 66 provided in the carriage 50 during the previous carriage scanning (S210).

Specifically, the sheet size identified in S110 is the sheet size notified from the external apparatus 90. There is no guarantee that the sheet size notified from the external apparatus 90 coincides with the size of the sheet P fed from the feeder tray 101. Therefore, in S210, the sheet size of the actually fed sheet P is identified in order to enhance precision of jam determination. The step of S210 may only be executed once after the sheet P is fed.

Thereafter, the jam determination area is reset based on the sheet size reidentified in S210 and the sheet quality identified from the print setting data (S220). Particularly, in S220, one of the area definition tables of the forward area definition table TBL1 and the backward area definition table TBL2 stored in the EEPROM 17 which corresponds to the scanning direction reset in the previous S200 is referred to. The area corresponding to the sheet size reidentified in S210 and the sheet quality specified from the print setting data is set to the jam determination area. In this manner, the jam determination area is reset (updated).

When the jam determination area is reset (updated), the process moves to S230. The CPU 11 assumes the area other than the jam determination area reset in S220 on the carriage conveyance path as a non-jam determination area. The threshold Th of each position on the carriage conveyance path is set in the same manner as in S150.

After S230, the process moves to S240. The CPU 11 inputs a command to the sheet conveyance controller 35 to make the sheet conveyance controller 35 convey the sheet P downstream in the conveyance direction by a distance of one path. The "distance for one path" herein corresponds to a length in the sub-scanning direction of an image formable on the sheet P by the "image forming operation for one path" in S170.

After S240, the process moves to S170. The CPU 11 makes the printing/motor controller 30 start the "image forming operation for one path" in the above-described manner and further executes the steps from S180 onwards.

When image forming operation till the last line is completed (S190: Yes), the process moves to S250. The CPU 11 inputs a command to the sheet conveyance controller 35 to make the sheet conveyance controller 35 execute a process of discharging the sheet P onto the discharge tray. Thereafter, in S260, the CPU 11 make the carriage controller 33 move the carriage 50 to the home position.

Moreover, the CPU 11 determines whether or not there is next page data of which image is not formed onto the sheet P in the print image data received from the external apparatus 90 (S270). If there is (S270: Yes), the process moves to S120. The steps from S120 onwards are executed. If there is no next page data (S270: No), the print control process is ended.

When a conveyance failure is detected by the carriage controller 33 during execution of the "image forming operation for one path" and detection of the conveyance failure is notified from the carriage controller 33 (S180: Yes), the CPU 11 obtains information of the suspended position X0 from the carriage controller 33 (S280), and determines whether or not the conveyance failure which has occurred is due to jamming based on the information of the suspended position X0 which is the position of the carriage 50 upon detection of the conveyance failure (S290). Particularly, when the suspended position X0 is within the jam determination area, it is determined that the conveyance failure is due to jamming, and when the suspended position X0 is out of the jam determination area, it is determined that the conveyance failure is not due to jamming. Here, the end points (the origin R1 and the end points R2) of the jam determination area are assumed within the jam determination area.

When it is determined that the conveyance failure is not due to jamming (S290: No), the process moves to S300. The CPU 11 inputs a command to the carriage controller 33 to make the carriage controller 33 start test conveyance operation. The "test conveyance operation" herein indicates operation of conveying the carriage 50 as follows. The carriage 50 is conveyed first from the "position where the carriage 50 has stopped by detection of the conveyance failure" to the end point on the scanning direction side of the carriage conveyance path in the scanning direction, then to the end on the opposite side of the carriage conveyance path, and further from the end point to the "position where the carriage 50 has stopped by detection of the conveyance failure".

In execution of the "test conveyance operation", the target speed trajectory of a speed lower than the target speed trajectory during execution of the "image forming operation for one path" is designated for the carriage controller 33. Thereby, the CPU 11 makes the carriage controller 33 convey the carriage 50 at a low, constant speed.

Specifically, in S300, the CPU 11 make the carriage controller 33 start execution of a process of making the carriage 50 reciprocate once at a low speed, assuming the position where the carriage 50 has stopped by detection of the conveyance failure" as a base point. Of course, at this time, the printing controller 31 is not operated so that the operation of ejecting ink drops is not performed.

After the test conveyance operation is started by the carriage controller 33, the CPU 11 stands by until a conveyance failure is detected by the carriage controller 33 or the test conveyance operation is completed (S310, S315).

The carriage controller 33 calculates the deviation e between the target speed Vr and the actual speed V by the same steps as those shown in FIG. 10. If the deviation e exceeds the failure determination value Er, detection of the conveyance failure is notified to the CPU 11, and also the carriage 50 is brought to an emergency stop.

In the present embodiment, a fixed value is predefined as an emergency failure determination value at a design stage. The fixed value is used as the failure determination value Er during the test conveyance. Moreover, a sufficiently small value is defined as the emergency failure determination value. This is because it is not preferable to force the carriage 50 to be conveyed under a state that the conveyance failure is once detected.

Hereinafter, in case that a conveyance failure is detected during the "image forming operation for one path" (i.e., when it is determined Yes in S180), the carriage controller 33 detects the conveyance failure by comparison between the emergency failure determination value Er and the deviation e at all times during conveyance of the carriage 50, during a period until the "image forming operation for one path" is restarted from when the conveyance failure is detected (i.e., the step of S330 is executed) or the conveyance failure is solved and the feeding operation is started (i.e., a period till it is determined Yes in S380 or S430 and the feeding operation by the step of S120 is started). When the conveyance failure is detected, the carriage controller 33 brings the carriage 50 to an emergency stop.

When the test conveyance operation is completed without detection of a conveyance failure (S315: Yes), the process moves to S320. The CPU 11 inputs a command to the carriage controller 33 to make the carriage controller 33 convey the carriage 50 to a restart position which is a predetermined distance upstream in the scanning direction away from the suspended position X0 and dispose the carriage 50 at the restart position. The distance from the restart position to the suspended position X0 is a distance necessary for the carriage 50 to shift from a stopped state to a constant speed state.

Thereafter, the CPU 11 inputs a command to the printing/motor controller 30 to make the printing/motor controller 30 restart the "image forming operation for one path" suspended by the detection of the conveyance failure (S330).

Particularly, the CPU 11 makes the carriage controller 33 convey the carriage 50 in the scanning direction from the above restart position by the steps shown in FIG. 10. Also, the CPU makes the recording unit 40 execute the ink ejection operation from the suspended position X0 through the printing controller 31. After the step of S330, the process moves to S180.

During the test conveyance, if it is determined by the carriage controller 33 that a conveyance failure is detected (S310: Yes), the process moves to S317. The CPU 11 outputs through the user interface 21 an alarm which notifies the user of occurrence of a conveyance failure and urges the user to solve the conveyance failure by way of a sound and a message. In S317, the type of the conveyance failure (whether or not the conveyance failure is due to jamming) is also notified to the user through the message in accordance with the determination result in S290. Thereafter, the present print control process is ended.

Subsequently, description is given on a process after it is determined that the conveyance failure is due to jamming (a process after it is determined Yes in S290) by way of FIG. 5. When it is determined that the conveyance failure is due to jamming, the process moves to S340. The process is switched over depending on that the scanning direction at the time of detection of the conveyance failure is "forward" or "backward". Particularly, when the scanning direction is "forward", the process moves to S350. When the scanning direction is "backward", the process moves to S390.

In S350, the CPU 11 inputs a command to the carriage controller 33 to make the carriage controller 33 execute an operation of backing up the carriage 50 to the home position.

At this time, similar to the time of the test conveyance, the carriage 50 is conveyed at a low, constant speed by the carriage controller 33.

After making the carriage controller 33 start the operation of backing up the carriage 50 to the home position, the CPU 11 stands by until a conveyance failure is detected by the carriage controller 33 or the carriage reaches the home position to complete capping (S360, S365).

When a conveyance failure is detected (S360: Yes) or the carriage reaches the home position (S365: Yes), the process moves to S370. In the same manner as in S317, an alarm is outputted through the user interface 21. Particularly, the user is notified of occurrence of a conveyance failure due to jamming and urged to solve jamming by output of the alarm.

After the output of the alarm, the CPU 11 stands by until an operation signal indicating that the failure is solved is inputted from the user through the user interface 21 (S380). When the operation signal is inputted from the user (S380: Yes), the process moves to S120. The image forming operation with respect to the page at the time of suspension of the image forming operation is started over from the feeding operation.

When the process moves to S390, the CPU 11 inputs a command to the carriage controller 33 to direct the carriage controller 33 to execute operation of backing up the carriage 50 to the flushing position. At this time, similar to the time of the test conveyance, the carriage 50 is conveyed at a low, constant speed by the carriage controller 33.

After making the carriage controller 33 start the operation of backing up the carriage 50 to the home position, the CPU 11 stands by until a conveyance failure is detected by the carriage controller 33 or the carriage 50 reaches the flushing position (S400, S405).

In case that a conveyance failure is detected (S400: Yes), the process moves to S420. The same alarm as in S370 is outputted through the user interface 21. Thereafter, the process moves to S430.

When the carriage 50 reaches the flushing position (S405: Yes), the process moves to S410. The same alarm as in S370 is outputted through the user interface 21. Also, the CPU 11 inputs a command to the printing controller 31 to start flushing operation. Specifically, ink drops are intermittently ejected from the nozzles toward the flushing foam by the recording unit 40 so that the nozzle portion is not clogged due to dry ink. Thereafter, the process moves to S430.

In S430, the CPU 11 stands by until the operation signal indicating that the failure is solved is inputted from the user through the user interface 21 (S430). When the operation signal is inputted (S430: Yes), the CPU 11 inputs a command to the printing controller 31 to finish the flushing operation (S440).

Then, the CPU 11 makes the carriage controller 33 convey the carriage 50 to the home position (S450). The process moves to S120. The image forming operation with respect to the page at the time of suspension of the image forming operation is started over from the feeding operation.

In the above, the image forming apparatus 1 of the present embodiment has been described. In the present embodiment, the area where a conveyance failure due to jamming may occur is defined as the jam determination area. When the carriage position at the time of detection of a conveyance failure is within the jam determination area, it is determined that the conveyance failure is due to jamming. When the carriage position at the time of detection of a conveyance failure is not within the jam determination area, it is determined that the conveyance failure is not due to jamming.

According to the image forming apparatus 1 of the present embodiment, whether or not the conveyance failure is due to jamming can be properly determined. Depending on the type of the conveyance failure, the succeeding process (an error process which handles the conveyance failure) can be appropriately switched over.

The present invention should not be limited to the above-described embodiment, but may be embodied in various forms. For instance, in the above embodiment, the size and quality of the sheet fed from the feeder tray 101 are identified, and the jam determination area is set in accordance with the identified sheet size and sheet quality. However, the area to be set as the jam determination area per sheet size and sheet thickness may be defined in the area definition tables. The image forming apparatus 1 may be configured such that the jam determination area corresponding to the sheet size and sheet thickness is set in S140, S220, based on the information on the identified sheet size and sheet thickness. In this case, as the sheet thickness is larger, the area which is shorter in the main scanning direction should be set as the jam determination area.

While, in the above embodiment, the speed of the carriage 50 is controlled by providing the carriage controller 33 the target speed trajectory, the carriage controller 33 may be configured to calculate a manipulated variable (control input) from a deviation between the position X of the carriage 50 and a target position Xr, and perform position control such that the position in the main scanning direction of the carriage 50 coincides with the target position. In this case, a target position trajectory is set for the carriage controller 33 so that the carriage 50 travels at a constant speed.

In the carriage controller 33, a conveyance failure is not necessary to be detected from the deviation e. For example, a conveyance failure may be detected by whether or not the manipulated variable u (control input) derived from the deviation e exceeds the failure determination value. Moreover, detection of a conveyance failure by the manipulated variable u is equivalent to detection of a conveyance failure by the driving voltage or driving current. Thus, the image forming apparatus 1 may be configured to detect a conveyance failure by the driving voltage or driving current of the CR motor 60.

In the above embodiment, the threshold Th of the position corresponding to the right and left side edges of the sheet passing area and the side edge located on the upstream side in the scanning direction is set to a minimum (the second threshold Th2). The threshold Th of this position is set smaller than the threshold Th of each of the other positions. The threshold Th is set to be gradually larger in the downstream in the scanning direction of that position. However, the threshold Th may be set as shown in FIG. 11.

Specifically, the second threshold Th2 may be set for the entire jam determination area, while the first threshold Th1 may be set for the entire non-jam determination area.

Figure 11:
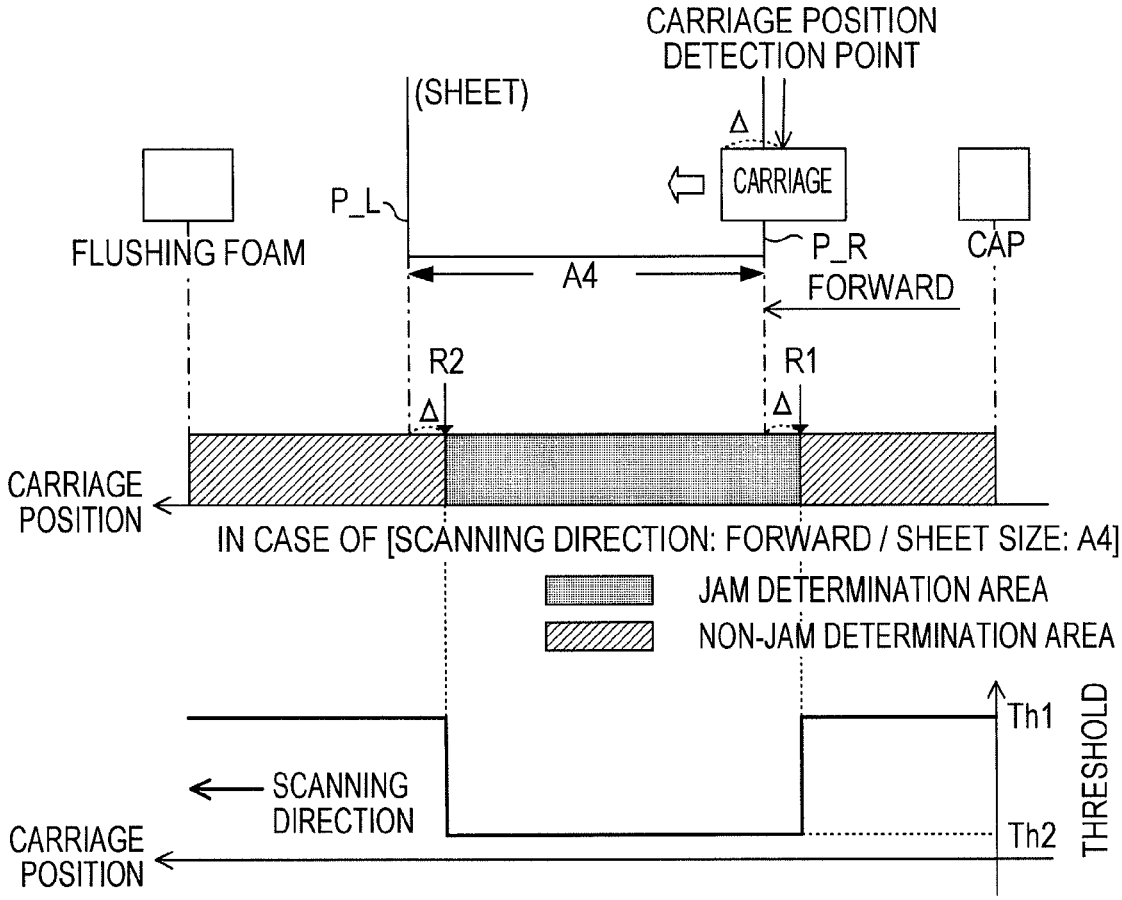
FIG. 11 is an explanatory view showing an example of configuration of the threshold Th (variation).

While, in the above embodiment, the end point R2 of the jam determination area is adjusted by sheet quality in consideration of the "deformability" of the sheet P, the end point R2 of the jam determination area may be set to a position away in the scanning direction from the origin R1 by a length in the main scanning direction of the sheet P (width of the sheet P), as shown in FIG. 11. In this case, the threshold Th of each position in the sheet passing area may be set to smaller than the threshold Th of each position outside the sheet passing area where the sheet P does not pass.

While, in the above embodiment, the sheet size and sheet quality are identified based on the print setting data which indicates the sheet size and sheet quality inputted by the user operating the external apparatus 90, a sensor that can detect the sheet size, sheet quality, sheet thickness may be provided in the device body in another embodiment. Based on detection information from the sensor, the sheet size as well as the "deformability" may be identified. A device constituted as such identifies the sheet size, sheet quality, sheet thickness, and so on, using the detection information of the sensor provided in the device body. Therefore, even if the sheet information indicated by the print setting data is wrong, it is possible to correctly distinguish between the area where jamming may occur and the area where jamming does not occur.

The present invention can be also applied to other electronic devices such as facsimile apparatus, and so on.

What is claimed is:

1. An electronic device comprising:

a carriage conveyance unit comprising a motor and configured to reciprocate a carriage along a main scanning direction by a driving force of the motor;

a sheet conveyance unit configured to convey a sheet in a sub-scanning direction perpendicular to the main scanning direction along which the carriage is reciprocated;

a failure detection unit configured to detect a conveyance failure of the carriage;

a position detection unit configured to detect a position of the carriage in the main scanning direction; and a jam determination unit configured to determine whether the conveyance failure is due to jamming caused by interference between the carriage and the sheet, based on the position of the carriage detected by the position detection unit and a scanning direction of the carriage at a time when the conveyance failure is detected by the failure detection unit, wherein the jam determination unit determines that the conveyance failure is due to jamming caused by interference between the carriage and the sheet when a leading end of the carriage in the main scanning direction is detected within a predetermined specific area on a carriage conveyance path at the time when the conveyance failure is detected, and wherein the specific area is defined within a sheet passing area, which is an area in the carriage conveyance path that faces the sheet conveyed in the sub-scanning direction by the sheet conveyance unit.

2. The electronic device as set forth in claim 1, wherein the specific area is defined for each of an outward path and a homeward path of the carriage, and the specific area corresponding to each of the outward path and the homeward path is defined for a portion of the sheet passing area based on a position on the carriage conveyance path facing one of the two side edges along the sub-scanning direction of the sheet conveyed by operation of the sheet conveyance unit, wherein the one side edge is positioned upstream in a conveyance direction of the carriage, and wherein the specific area for the outward path is different from the specific area for the homeward path.

3. The electronic device as set forth in claim 1, wherein the carriage conveyance unit is configured to determine a driving voltage or a driving current inputted to the motor from a deviation between an actual speed or an actual position in the main scanning direction of the carriage and a target value for the speed or the position thereby to feedback control the speed or the position in the main scanning direction of the carriage to conform to the target value, and to convey the carriage in the main scanning direction along a target speed trajectory or a target position trajectory by the feedback control, and the failure detection unit detects the conveyance failure when one of the deviation, the driving voltage and the driving current exceeds each threshold.

4. The electronic device as set forth in claim 3, wherein a length in the main scanning direction of the carriage conveyance path is longer than a length in the main scanning direction of the sheet conveyed by the sheet conveyance unit, the threshold is defined for each position on the carriage conveyance path along the main scanning direction, and the threshold of each position in the specific area in the carriage conveyance path is defined smaller than the threshold of each position outside the specific area.

5. The electronic device as set forth in claim 3, wherein a length in the main scanning direction of the carriage conveyance path is longer than a length in the main scanning direction of the sheet conveyed by the sheet conveyance unit, the threshold is defined for each position on the carriage conveyance path along the main scanning direction, and the threshold of a position corresponding to an end of the specific area on an upstream side in the conveyance direction of the carriage in the carriage conveyance path is defined smaller than the threshold of the other positions.

6. The electronic device as set forth in claim 1, further comprising:

a notification unit that notifies a user of occurrence of jamming when it is determined by the jam determination unit that the conveyance failure is due to jamming.

7. The electronic device as set forth in claim 1, wherein the electronic device is an image forming apparatus which mounts on the carriage a recording unit that can eject ink drops onto the sheet, the electronic device further comprising:

an image forming unit that, upon input of an image forming command, directs the carriage conveyance unit to convey the carriage in the main scanning direction, directs the sheet conveyance unit to convey the sheet in the sub-scanning direction, and directs the recording unit eject ink drops when the carriage travels in the main scanning direction, thereby forming an image specified in the image forming command on the sheet.

8. The electronic device as set forth in claim 7, further comprising:

an image formation suspension unit that suspends image forming operation by the image forming unit when the conveyance failure is detected by the failure detection unit; and a failure handling unit that, when the conveyance failure is detected by the failure detection unit and the conveyance failure is determined due to jamming by the jam determination unit, directs the carriage conveyance unit to convey the carriage in an opposite direction to the conveyance direction upon occurrence of the conveyance failure.

9. The electronic device as set forth in claim 8, wherein a capping portion for capping a nozzle portion which ejects ink drops of the recording unit is provided on one end of the carriage conveyance path, and a flushing portion for accumulating ink drops ejected by flushing operation of the recording unit on an opposite end to the end provided with the capping portion, and the failure handling unit is configured to direct the carriage conveyance unit to convey the carriage in the opposite direction to dispose the recording unit at the capping portion or the flushing portion.

10. The electronic device as set forth in claim 8, further comprising:

a conveyance suspension unit that suspends conveyance operation of the carriage by the carriage conveyance unit in case that the conveyance failure is detected by the failure detection unit when the carriage is conveyed in the opposite direction by operation of the failure handling unit.

11. The electronic device as set forth in claim 8, further comprising:

a test conveyance unit that directs the carriage conveyance unit to convey the carriage so that the carriage reciprocates once in the carriage conveyance path, when the conveyance failure is detected by the failure detection unit and it is determined by the jam determination unit that the conveyance failure is not due to jamming, a test suspension unit that suspends conveyance operation of the carriage by the carriage conveyance unit in case that the conveyance failure is detected by the failure detection unit during conveyance of the carriage by the test conveyance unit; and a restart control unit that directs the image forming unit to restart the suspended image forming operation in case that the conveyance failure is not detected by the failure detection unit while the carriage reciprocates once by operation of the test conveyance unit.

12. An electronic device comprising:

a carriage conveyance unit that includes a motor and conveys a carriage in a main scanning direction by a driving force of the motor;

a sheet conveyance unit that conveys a sheet in a sub-scanning direction which crosses the main scanning direction in which the carriage is conveyed;

a failure detection unit that detects a conveyance failure of the carriage;

a position detection unit that detects a position of the carriage in the main scanning direction; and a jam determination unit that determines if the conveyance failure is due to jamming caused by interference between the carriage and the sheet, based on the position of the carriage detected by the position detection unit at a time when the conveyance failure is detected by the failure detection unit, wherein the specific area is defined per type of the sheet conveyed by the sheet conveyance unit, and the jam determination unit is configured to determine if the conveyance failure is due to jamming based on information on the specific area corresponding to the type of the sheet being conveyed by the sheet conveyance unit.

13. The electronic device as set forth in claim 12, wherein the specific area is defined per size of the sheet.

14. The electronic device as set forth in claim 12, wherein the specific area is defined per thickness of the sheet.

15. The electronic device as set forth in claim 14, wherein a length in the main scanning direction of the specific area is defined to be smaller as the sheet becomes thicker.

* * * * *